US006032616A

United States Patent [19]

Jones

[11] Patent Number: 6,032,616

[45] Date of Patent: Mar. 7, 2000

[54] RAPID RESPONSE HOT WATER HEATER

[76] Inventor: Leslie J. Jones, 42 Clarendon Ave., Greenville, S.C. 29609

[21] Appl. No.: 09/023,476

[22] Filed: Feb. 13, 1998

[51] Int. Cl.[7] ..... F22B 1/18

[52] U.S. Cl. ..... 122/32; 122/17; 15/321

[58] Field of Search ..... 165/158, 160; 15/320, 321; 122/17, 31.1, 32, 33, 51, 53

[56] References Cited

U.S. PATENT DOCUMENTS

| | | | |
|---|---|---|---|
| 2,295,785 | 11/1942 | Handley | 122/14 |
| 3,756,202 | 9/1973 | Keith | 122/156 |
| 3,915,124 | 10/1975 | Kuhn, Jr. et al. | 122/115 |
| 4,443,909 | 4/1984 | Cameron | 15/321 |
| 4,470,359 | 9/1984 | Smith | 110/234 |
| 4,579,086 | 4/1986 | Maton | 122/17 |
| 5,220,887 | 6/1993 | Hiddleston et al. | 122/17 |
| 5,371,918 | 12/1994 | Shero | 122/17 |
| 5,437,248 | 8/1995 | Miura et al. | 122/17 |
| 5,775,268 | 7/1998 | Ferguson | 122/17 |

*Primary Examiner*—Philip H. Leung
*Assistant Examiner*—Gregory A. Wilson
*Attorney, Agent, or Firm*—Dority & Manning, P.A.

[57] ABSTRACT

A hot water heater for generating substantial instantaneous hot water by positioning a plurality of burners adjacent one end of a heat transfer section. The heat transfer section includes an elongated housing which has a plurality of tubes carried therein. Water is circulated through the elongated housing for being heated by the products of combustion being generated by the burners being drawn within the elongated tubes by means of a vacuum. A combustion chamber in which the burners are carried is frusto-conical in shape with the large diameter end being exposed to the atmosphere and the small diameter end being in communication with the heat transfer section.

11 Claims, 5 Drawing Sheets

RAPID RESPONSE HOT WATER HEATER

BACKGROUND OF THE INVENTION

This invention relates to a hot water heater and more particularly to a gas operated heater which produces hot water almost instantaneously.

Heretofore, gas has been utilized for heating water in hot water heaters. Normally, most hot water heaters have a storage tank for maintaining a given volume of water at a pre-determined temperature for use on demand. One problem with such hot water heaters is that a substantial amount of energy is required for storing the heated water.

While hot water heaters are available which utilizes coils so that heated water can be delivered upon demand, normally there is the delay between the time that the demand is made and when a supply of water can be produced at a given temperature.

SUMMARY OF THE INVENTION

Accordingly, it is an important object of the present invention to provide a hot water heater wherein water of a desired temperature can be produced within seconds of turning on a spigot or a valve.

Another important object of the present invention is to provide a hot water heater that is extremely efficient and utilizes a minimum amount of fuel for producing a given volume of hot water.

Still another important object of the present invention is to provide a hot water heater which is simple in construction and has very few moving parts therein.

Still another important object of the present invention is to provide a hot water heater which is extremely efficient in transferring heat from hot products of combustion generate by a plurality of burners to water for heating the water.

The improved water heater is connected to a source of fossil fuel for heating water and includes a combustion chamber that includes a frusto-conical shaped housing. A plurality of burners are carried in the combustion chamber for generating hot products of combustion from fuel such as propane gas. A heat transfer section is connected to the small end of the combustion chamber and includes a plurality of elongated tubes carried within an elongated pipe. The outer surfaces of the elongated tubes are sealed adjacent the ends of the elongated pipe and one end of the tubes communicates with the combustion chamber and the other end terminates adjacent the other end of the pipe. A water inlet port and a water outlet port is provided in the pipe so that cold water can be fed through the inlet port into the pipe and travels along the outer surfaces of the elongated tubes prior to exiting out of the outlet port.

A source of vacuum is connected to the outlet end of the tubes for drawing products of combustion from the combustion chamber into the elongated tubes for heating water moving about the outer surface of the tubes. Thus, a continuous flow of hot water is produced at the output port of the water circulation system.

DESCRIPTION OF THE PREFERRED EMBODIMENTS

Figure 1:
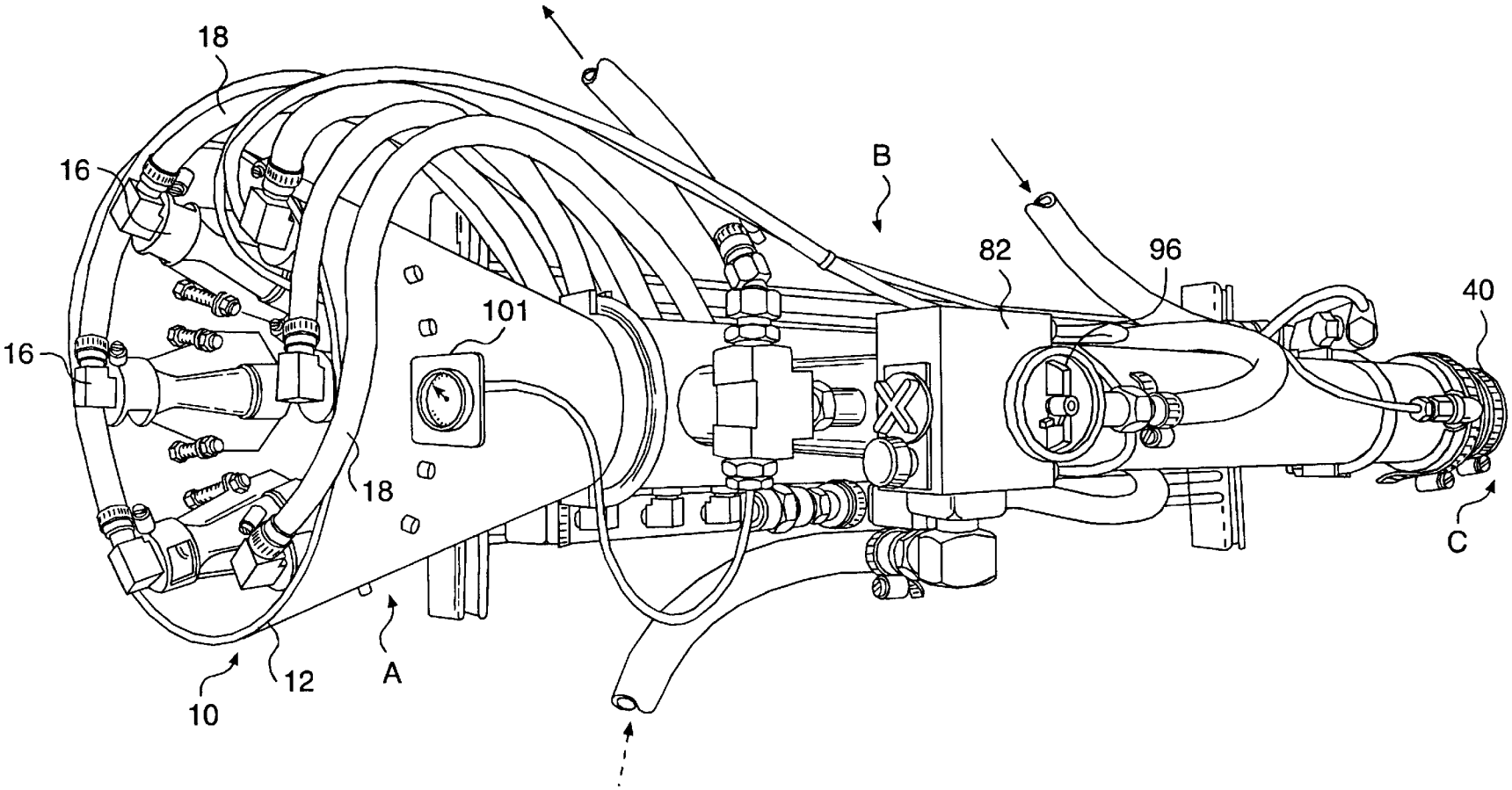
FIG. 1 is a perspective view taken from the top of a water heater constructed in accordance with the present invention.
Figure 2:
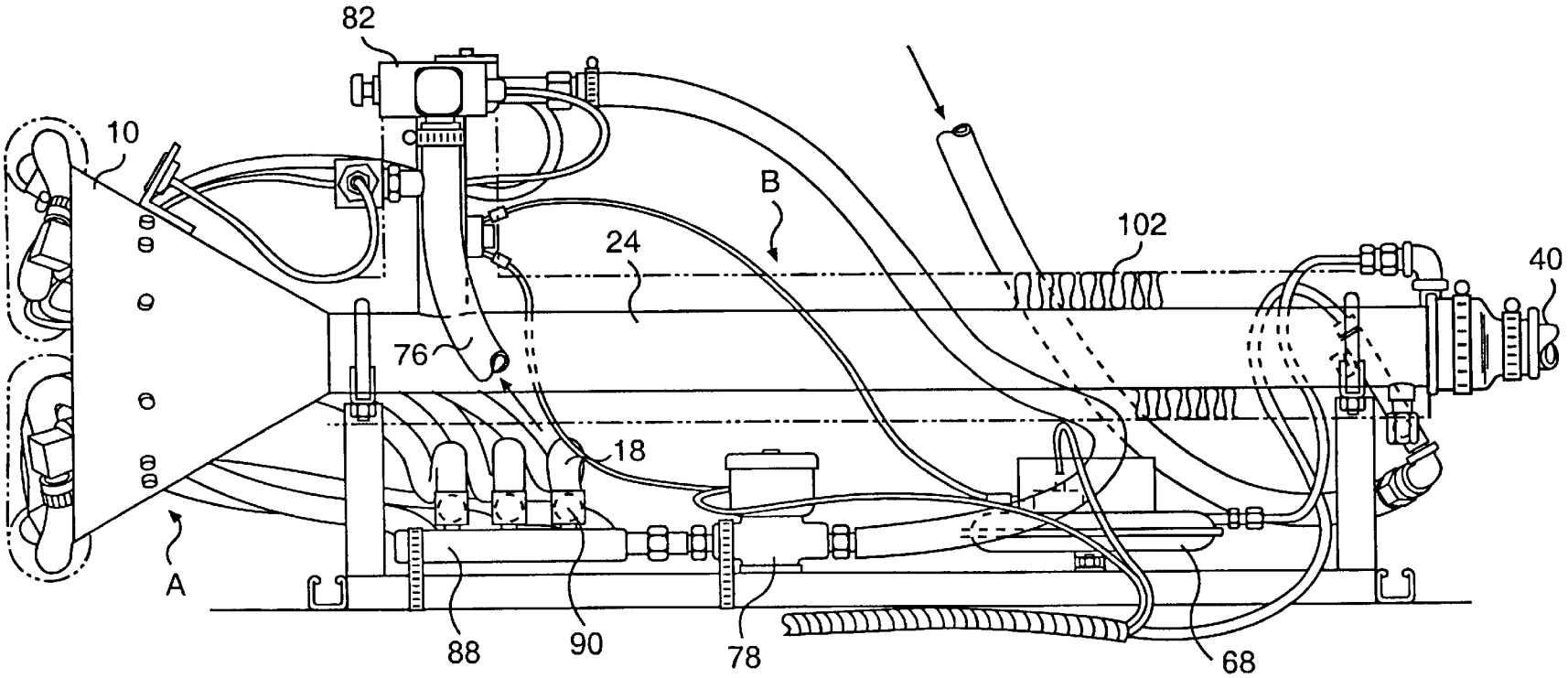
FIG. 2 is a side view partially in section illustrating the water heater of FIG. 1.
Figure 3:
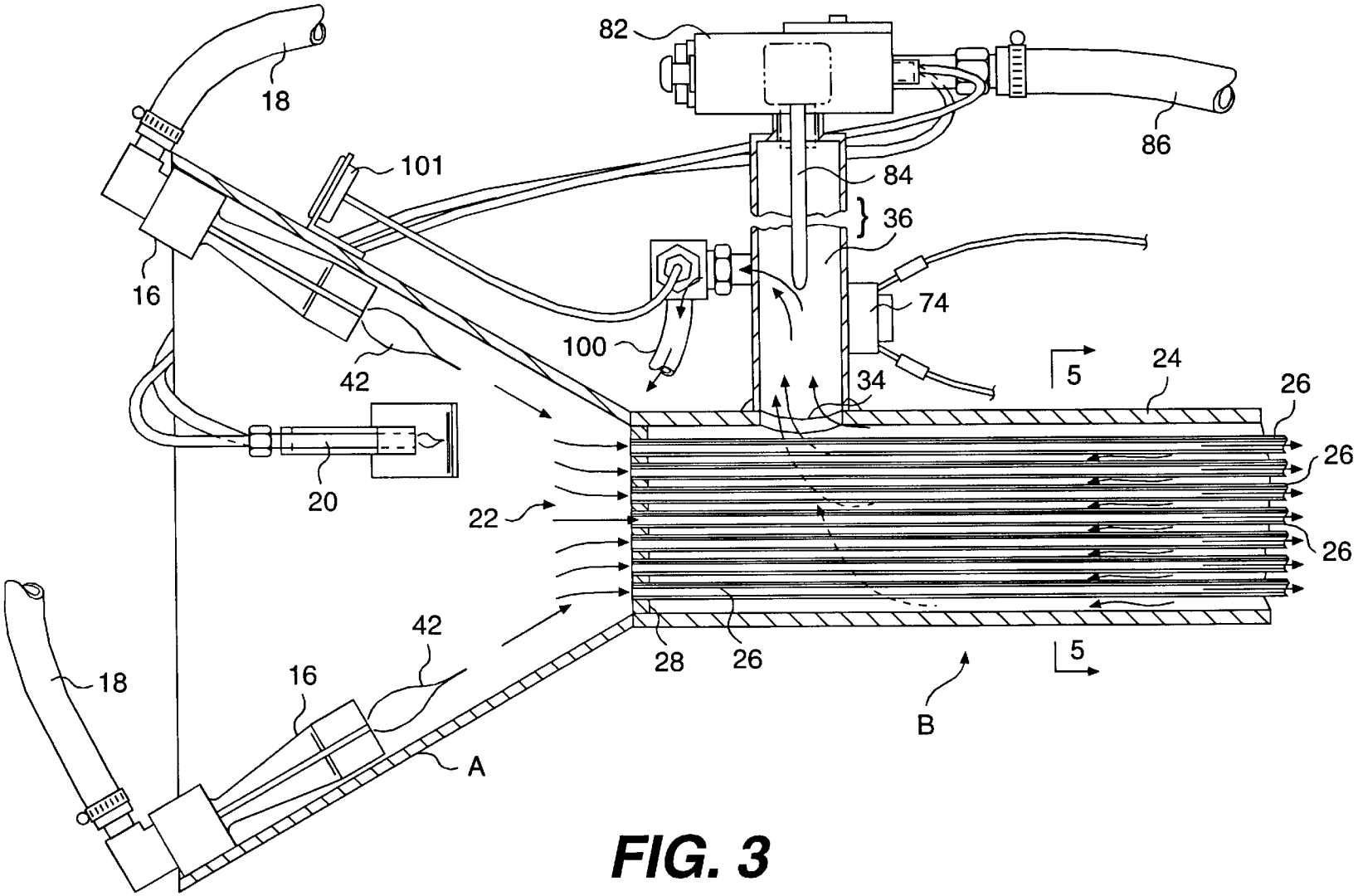
FIG. 3 is a cross-sectional view of the water heater illustrating one end of the water heater.
Figure 4:
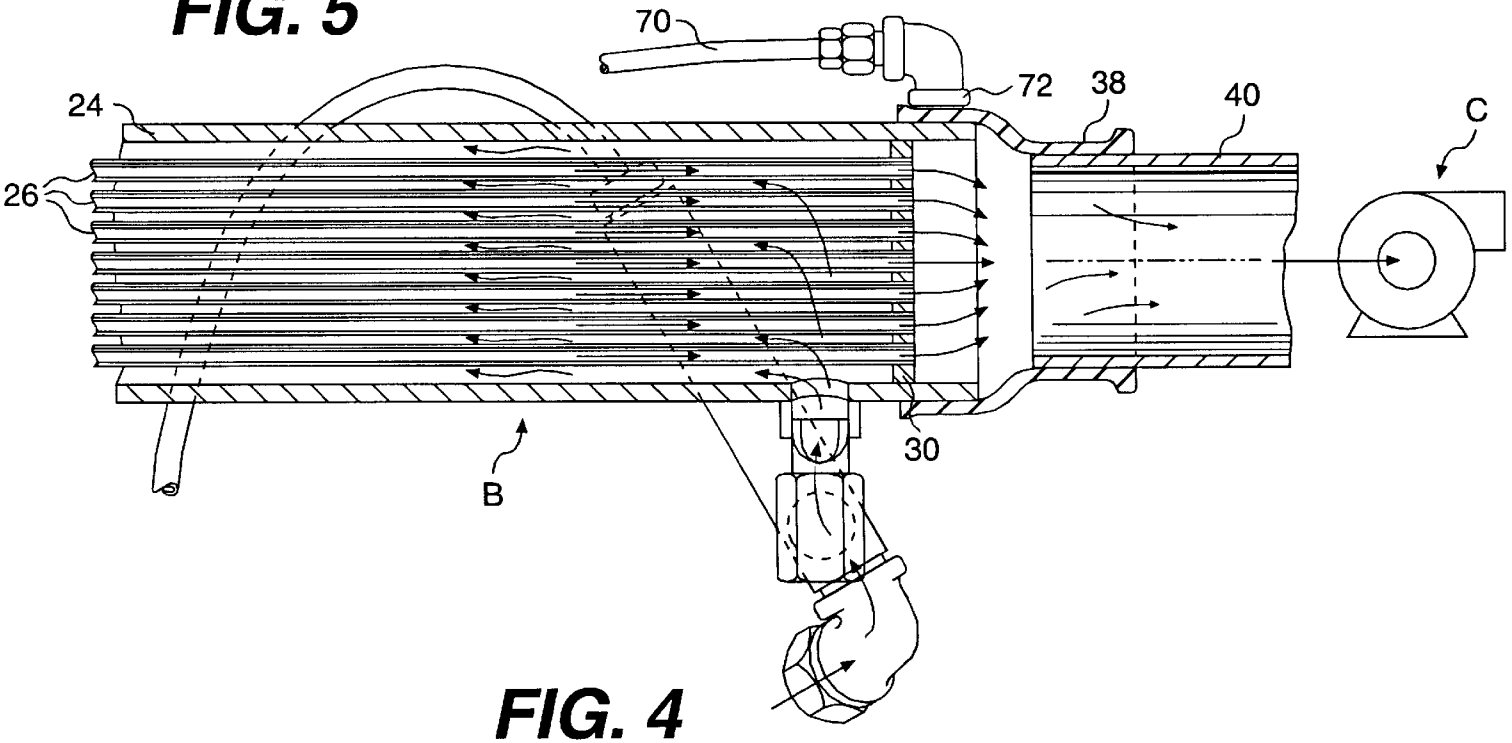
FIG. 4 is a cross-sectional view of the water heater constructed in accordance with the present invention illustrating the other end of the water heater.

Referring to the drawings, there is illustrated a water heater connected to a source of fossil fuel such as a tank 10 of propane gas. The water heater includes a combustion chamber A which has one end thereof connected to a heat transfer section B. A source or vacuum C is connected to a distal end of the heat transfer section for drawing hot products of combustion created in the combustion chamber through the heat transfer section B for heating water as it flows through the heat transfer section to an outlet water pipe D.

The combustion chamber A is a frusto-conical metal housing 10 that has its large diameter end 12 exposed to the atmosphere. Its small diameter end 14 is connected to the heat transfer section B. Conventional gas burners 16 are circumferentially spaced around the inside surface of the frusto-conical metal housing B and each has connected thereto a gas supply hose 18. Gas is supplied from a propane tank 10 or any other suitable source of fuel. A pilot light 20 is carried within the central portion of the combustion chamber for causing the burners 16 to be ignited when gas is supplied to the burners. The pilot light may be any conventional igniter such as a pilot light. The burners 16 may be attached to the inside surface of the frusto-conical metal combustion chamber B by any suitable means such as bolts. The burners are directed inwardly at an angle so that the output thereof is directed towards the small diameter end of the combustion chamber. As a result, the hot products of combustion from the burners enter an inlet end 22 of the heat transfer section B.

Figure 5:
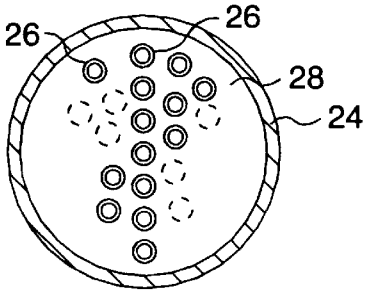
FIG. 5 is a sectional view taken along lines 55 of FIG. 3.

The heat transfer section B includes an elongated tubular housing 24 constructed in one particular embodiment of metal. The housing 24 is an elongated, hollow metal tube and may be constructed of any suitable material such as copper or brass. In one particular heater, the housing 24 is a 2 inch I.D. pipe. A plurality of elongated tubes 26 which may be constructed of any suitable material such as copper, brass, stainless steel, etc. are carried within the tubular housing 24 and are spaced from each other so that water can pass around the outer surfaces of the tubes 26. In one particular heater which utilizes a 2 inch I.D. pipe there are fifty-five 3/16 inch O.D. tubes 26 having a 1/8 inch I.D. The size of the housing 24 would vary depending on the volume of hot water desired. The tubes 26 are held in position by means of a cylindrical plate 28 that has holes provided therein into which the ends of the tubes 26 are positioned and sealed therein by any suitable means such as brazing or welding. A similar plate 30 is provided in the other end of the pipe 24 for securing and sealing the exit ends of the tubes 26 in a space relationship such as shown in FIG. 5.

A water circulation system is connected to the tubular housing 24 by means of an inlet port 32 which allows water to flow into the tubular housing around the outer surfaces of the tubes 26. The water exits out of the tubular housing 24 through an exit port 34 into a manifold 36. A coupling 38 is connected to the end of the tubular housing 24 for receiving a vacuum hose 40. The vacuum hose, in turn, is connected to any suitable source of vacuum C such as shown diagrammatically by the vacuum pump C. The vacuum pump C provides a source of vacuum which draws the products of combustion from the combustion chamber A into an inlet end of the tubes 26. Such causes the tubes to heat. Water flowing through the inlet port 32 passes around the outside surfaces of the tubes 26 and exits out of the outlet port 34. As the water engages the outer surface of the tubes 26, the water is heated, producing hot water within a matter of seconds after the burners 16 are turned on. Since the hot products of combustion 42 are drawn within the inlet ends of the tubes 26, there is an extremely efficient transfer of heat from the hot gases to the water passing around the outside of the tubes. The air exiting out of the remote end of the housing 24 adjacent to vacuum tube 40 is of a temperature substantially equal to that of the water entering the housing 24.

The hot water heater is provided with various controls and safety devices to ensure that water is flowing through the tube 24 and a vacuum is applied to the heat transfer section B prior to igniting the burners 16. The hot water heater is also provided with safety switches that cut off the entire system if the water exceeds a predetermined temperature.

Figure 6:
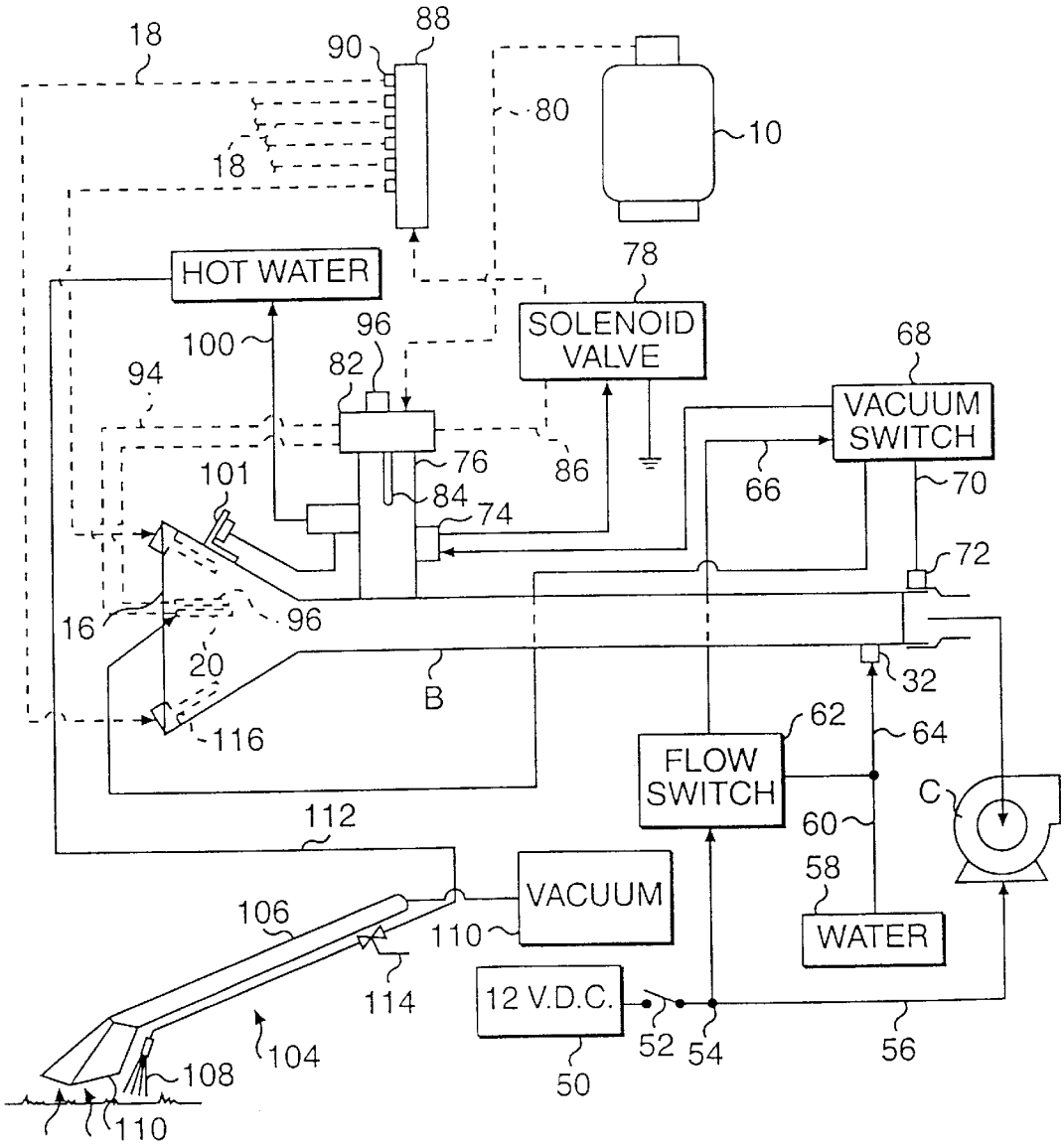
FIG. 6 is a schematic diagram illustrating the electrical controls and flow paths of the gas, electricity and water of the heater constructed in accordance with the present invention.

Referring now to FIG. 6 of the drawings, the controls for the hot water heater will be discussed. A source of electrical power is provided by any suitable source of power and in one particular embodiment is a 12 volt DC battery 50. The DC battery is connected through an electrical on-off switch 52 to terminal 54. A lead line 56 is connected between terminal 54 and the vacuum pump C. As a result, when switch 52 is closed, vacuum pump C is turned on. A source of water 58, which is to be heated, is fed through conduit 60 to a flow switch 62. The source of water is also fed through conduit 64 to inlet port 32 of the heat transfer section B. When water flows to flow switch 62, it allows current to pass through the flow switch by means of lead 66 to an input of vacuum switch 68. Another input 70 is coupled to vacuum switch 68 and is connected to a sensor 72 communicating with the output end of the heat transfer section B. As a result, before the vacuum switch 68 is opened to allow current to pass, vacuum must be present at the outer end of the heat transfer section B.

When there is a vacuum applied to the end of the heat transfer section B, electricity is permitted to flow through the vacuum switch to a temperature limit switch 74. The temperature limit switch 74 can be set to any desired setting and is activated responsive to the temperature in a manifold 76 through which the hot water passes as it exits from the heat transfer section. Assuming the hot water exiting from the heat transfer section B is below the cut-off setting of the thermal switch 74, then current is allowed to flow to solenoid valve 78.

Solenoid valve 78 is provided for controlling the flow of gas from the tank 10 to the burners 16. When solenoid valve 78 is activated, gas is allowed to flow through the hoses represented by the dotted line 80 into a gas control valve 82. The gas control valve 82 has a built-in thermostat which is activated by a sensor 84. The sensor 84 in turn senses the temperature of the water passing through the manifold 76.

If the temperature of the water is below a set temperature, then gas is allowed to flow through the gas control valve 82 through line 86 to a manifold 88. The manifold 88 has six outlets 90 that are in turn connected by gas lines 18 to the respective gas burners 16. The gas control valve 82 also supplies gas by means of line 94 to the pilot light 20. A thermal couple 96 is associated with the pilot light 20 so that if the pilot light goes off, the thermal couple 96, in turn, sends a signal to the gas control valve 82 for cutting off the gas to the pilot light 20. The gas control valve 82 has a knob 96 provided thereon which can be rotated to adjust the flow of gas through the gas control valve to the desired volume for raising and lowering the temperature of the water passing through the manifold 76 to the output line 100.

As a result of the controls described above in connection with FIG. 6, if there is no vacuum applied to the pipe 24, then the hot water heater cannot be operated. Similarly, if there is no water supplied to the hot water heater, it will not turn on the flow switch 62, which in turn activates the vacuum switch. The vacuum switch must also be activated to turn on the solenoid valve 78, which in turn, controls the flow of gas to the burners.

As a result of the efficiency of the hot water heater shown and described in the drawings, it is capable of producing a high volume of water with a relatively small heater. It is also extremely efficient in that as a result of the burners being carried on the inside wall of the frusto-conical shaped combustion chambers and being directed to the input of the tubes 26, there is a uniform heat build up adjacent to the entrance of the tubes 26. This heat is pulled into the tubes by the source of vacuum for heating the tubes. Heat is transferred through the tubes to the water passing around the outside surface of the tubes. As shown, the system could very well be activated by pressure-operated switches carried on wands that are used in carpet cleaning systems. Normally when cleaning carpet with hot water, the water is sprayed onto the carpet through a wand. The flow of water to the wand is controlled by a finger-operated valve. As a result of manipulating this valve, the water pressure changes.

A temperature gauge 100 is provided for indicating the output temperature of the hot water. In order to increase the efficiency of the hot water, an insulated jacket 102 of any suitable construction, can be wrapped around the elongated pipe 24.

The hot water heater is particularly designed for use with carpet cleaning equipment which utilizes a cleaning wand 104 that includes an elongated tubular housing 106 that has a plurality of spray nozzles 108 connected to the lower end thereof. A source or vacuum 110 is connected to the upper end of the tubular handle 106 for drawing vacuum through a nozzle 108. Hot water is supplied from the hot water heater through an elongated hose 112. A hand operated valve 114 is carried by the wand and is connected to the hose 112 between the upper end of the wand and the nozzles 108. By manipulating the valve 114 the flow of water being sprayed through the nozzles can be controlled. Since there is a flow switch 62 in the hot water circuit, each time the valve 114 is opened to allow water to be sprayed on the carpet the hot water heater turns on as a result of water flowing from the source 58 to the flow switch 62. The temperature of the water shown on the gage 100 can be raised from tap water temperature to 230° within seven seconds after the valve 114 is opened. After water reaches its initial temperature of say 230°, it remains at that temperature during the cleaning operation.

If desired, a cleaning composition can be attached to the hose 112 for being sprayed on the carpet with the hot water. The injection of the cleaning solution can be accomplished in any suitable conventional manner. In some systems however, instead of injecting the cleaning solution into the water, the carpet is pre-sprayed with a cleaning solution and only the hot water is spread on the carpet. As the carpet is being sprayed with the hot water, the operator pulls the wand rearwardly and the vacuum 110 coupled to the upper end of the wand sucks the dirty water from the carpet back up through the wand to a receiving tank not shown.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims:

What is claimed:

1. A water heater connected to a source of fossil fuel for heating water, comprising:

a combustion chamber;

a plurality of burners carried in said combustion chamber generating hot products of combustion from said fuel;

a heat transfer section;

a water inlet port and a water outlet port provided in said heat transfer section;

a plurality of horizontally extending elongated tubes carried in said heat transfer section, each having outside surfaces;

a water circulation system for moving cold water from said inlet port about the outside of said plurality of tubes and out said outlet port for transferring heat from said tubes to said water;

said elongated tubes having an inlet end and an outlet end;

said inlet ends of said tubes communicating with said combustion chamber;

a source of vacuum connected to said outlet end of said tubes for drawing product of combustion from said combustion chamber into said horizontally extending elongated tubes for heating water moving about said outsides of said tubes, whereby a continuous flow of hot water is produced at said outlet port of said water circulation system; and supporting structure for said burners holding said burners in a position to direct the products of combustion from said burners towards said inlet ends of said tubes.

2. The water heater as set forth in claim 1 further comprising:

said heat transfer section including an elongated tubular housing having an inlet end and an outlet end;

said plurality of elongated tubes extending from adjacent said inlet end of said housing to adjacent said outlet end of said housing;

a seal provided between outer surfaces of said tubes and an inner wall of said housing adjacent said inlet end of said housing, and a seal provided between said outer surfaces of said tubes and said inner wall of said tubular housing adjacent said outlet end of said tubular housing.

3. The water heater as set forth in claim 1 wherein said burners are circumferentially spaced around said inlet ends of said tubes for directing said hot products of combustion directly into said inlet ends of said tubes.

4. A water heater connected to a source of fossil fuel for heating water, comprising:

a combustion chamber;

a plurality of burners carried in said combustion chamber generating hot products of combustion from said fuel;

a heat transfer section;

a water inlet port and a water outlet port provided in said heat transfer section;

a plurality of elongated tubes carried in said heat transfer section;

a water circulation system for moving cold water from said inlet port about the outside of said plurality of tubes and out said outlet port for transferring heat from said tubes to said water;

said elongated tubes having an inlet end and an outlet end;

said inlet ends of said tubes communicating with said combustion chamber; and a source of vacuum connected to said outlet end of said tubes for drawing products of combustion from said combustion chamber into said elongated tubes for heating water moving about said outsides of said tubes, whereby a continuous flow of hot water is produced at said outlet port of said water circulation system;

said combustion chamber is frusto-conical in shape and has a large diameter end and a small diameter end;

said plurality of burners being positioned within said frusto-conical chamber;

said small diameter end being in communication with said heat transfer section; and said larger diameter end being exposed to the atmosphere.

5. The water heater as set forth in claim 2 further comprising:

said burners being carried on an inside wall of said frusto-conical shaped chamber and are directed downwardly towards said inlet end of said elongated tubes so that said hot products of combustion are drawn into said tubes by said source of vacuum.

6. A water heater connected to a source of fossil fuel for heating water, comprising:

a combustion chamber;

a plurality of burners carried in said combustion chamber generating hot products of combustion from said fuel;

a heat transfer section;

a water inlet port and a water outlet port provided in said heat transfer section;

a plurality of elongated tubes carried in said heat transfer section;

a water circulation system for moving cold water from said inlet port about the outside of said plurality of tubes and out said outlet port for transferring heat from said tubes to said water;

said elongated tubes having an inlet end and an outlet end;

said inlet ends of said tubes communicating with said combustion chamber; and a source of vacuum connected to said outlet end of said tubes for drawing products of combustion from said combustion chamber into said elongated tubes for heating water moving about said outsides of said tubes, whereby a continuous flow of hot water is produced at said outlet port of said water circulation system;

a valve interposed between said source of fossil fuel and said burners; and a vacuum switch connected to said heat transfer section for sensing the absence of vacuum in said heat transfer section and closing said valve to prevent fuel from being supplied to said burners to prevent said burners from being ignited unless said source of vacuum is being applied.

7. The water heater as set forth in claim 6 further comprising;

said heat exchanger includes an elongated tubular member having an internal diameter of about two inches, and there are about fifty-five elongated tubes carried within said elongated tubular member.

8. A water heater connected to a source of fossil fuel for heating water, comprising:

a combustion chamber;

a plurality of burners carried in said combustion chamber generating hot products of combustion from said fuel;

a heat transfer section;

a water inlet port and a water outlet port provided in said heat transfer section;

a plurality of elongated tubes carried in said heat transfer section;

a water circulation system for moving cold water from said inlet port about the outside of said plurality of tubes and out said outlet port for transferring heat from said tubes to said water;

said elongated tubes having an inlet end and an outlet end;

said inlet ends of said tubes communicating with said combustion chamber; and a source of vacuum connected to said outlet end of said tubes for drawing products of combustion from said combustion chamber into said elongated tubes for heating water moving about said outsides of said tubes, whereby a continuous flow of hot water is produced at said outlet port of said water circulation system;

a gas control valve interposed between said source of fuel and said burners for controlling the flow of fuel to said burners; and a temperature sensor operatively connected to said gas control valve for sensing the temperature of said water exiting from said heat transfer section and for causing said gas control valve to cut off the supply of fuel to said burners when said water temperature exceeds a pre-set value.

9. The water heater as set forth in claim 6 further comprising:

a source of electrical power;

a solenoid valve operately connected to said gas control valve for opening said gas control valve when energized;

a flow switch connected between said source of electrical power and said solenoid valve being activated by flowing water for connecting said source of power to said solenoid valve only when water is flowing in said circulation system.

10. A carpet cleaning apparatus for spraying a hot cleaning solution onto carpet through spray nozzles and withdrawing spent cleaning solution from said carpet with a cleaning head connected to a source of vacuum, said spray nozzles being carried by said cleaning head, a hose connecting said nozzles to a source of hot cleaning solution, and a valve opening and closing the flow of cleaning solution through said hose for controlling the flow of cleaning solution to said nozzles, said source of hot cleaning solution comprising:

a water heater connected to a source of fossil fuel for heating water, including;

a combustion chamber;

a plurality of burners carried in said combustion chamber generating hot products of combustion from said fuel;

a heat transfer section;

a water inlet port and a water outlet port provided in said heat transfer section;

a plurality of elongated tubes carried in said heat transfer section;

a water circulation system for moving cold water from said inlet port about the outside of said plurality of tubes and out said outlet port for transferring heat from said tubes to said water;

said elongated tubes having an inlet end and an outlet end;

said inlet ends of said tubes communicating with said combustion chamber;

a source of vacuum connected to said outlet end of said tubes for drawing products of combustion from said combustion chamber into said elongated tubes for heating water moving about said outsides of said tubes, whereby a continuous flow of hot water is produced at said outlet port of said water circulation system; and supporting structure for said burners holding said burners in a position to direct said products of combustion from said burners towards said inlet ends of said tubes.

11. A carpet cleaning apparatus for spraying a hot cleaning solution onto carpet through spray nozzles and withdrawing spent cleaning solution from said carpet with a cleaning head connected to a source of vacuum, said spray nozzles being carried by said cleaning head, a hose connecting said nozzles to a source of hot cleaning solution, and a valve opening and closing the flow of cleaning solution through said hose for controlling the flow of cleaning solution to said nozzles, said source of hot cleaning solution comprising:

a water heater connected to a source of fossil fuel for heating water, including;

a combustion chamber;

a plurality of burners carried in said combustion chamber generating hot products of combustion from said fuel;

a heat transfer section;

a water inlet port and a water outlet port provided in said heat transfer section;

a plurality of elongated tubes carried in said heat transfer section;

a water circulation system for moving cold water from said inlet port about the outside of said plurality of tubes and out said outlet port for transferring heat from said tubes to said water;

said elongated tubes having an inlet end and an outlet end;

said inlet ends of said tubes communicating with said combustion chamber;

a source of vacuum connected to said outlet end of said tubes for drawing products of combustion from said combustion chamber into said elongated tubes for heating water moving about said outsides of said tubes, whereby a continuous flow of hot water is produced at said outlet port of said water circulation system;

said combustion chamber being frusto-conical in shape and has a large diameter end and a small diameter end;

said plurality of burners being positioned within said frusto-conical chamber;

said small diameter end being in communication with said heat transfer section; and said large diameter end being exposed to the atmosphere.

* * * * *